United States Patent [19]

Schad

[11] Patent Number: 4,892,055

[45] Date of Patent: Jan. 9, 1990

[54] REINFORCED HULL FOR A WATER CRAFT

[76] Inventor: Robert D. Schad, 110 Bloor Street West, Suite 2104, Toronto, Ontario, Canada

[21] Appl. No.: 228,496

[22] Filed: Aug. 5, 1988

[51] Int. Cl.[4] ..... B63B 5/24

[52] U.S. Cl. ..... 114/357; 114/219; 114/343

[58] Field of Search ..... 244/100, 101, 105, 106; 114/56, 352, 353, 343, 355, 356, 357, 219

[56] References Cited

U.S. PATENT DOCUMENTS

| | | | |
|---|---|---|---|
| 3,085,262 | 4/1963 | Plemmons | 114/355 |
| 3,190,587 | 6/1965 | Fries | 114/355 |
| 3,680,516 | 8/1972 | Loverdos-Stelakatos | 114/167 R |
| 3,822,427 | 7/1974 | Ewart, Jr. | 114/352 |
| 4,022,143 | 5/1977 | Krenzler | 114/56 |
| 4,667,619 | 5/1987 | Nishida | 114/357 |
| 4,676,545 | 6/1987 | Bonfilio et al. | 296/197 |
| 4,697,762 | 10/1987 | Arney | 244/101 |
| 4,739,723 | 4/1988 | Plucknett | 114/361 |
| 4,741,284 | 5/1988 | Madison | 114/357 |
| 4,762,080 | 8/1988 | Pearson | 114/343 |

*Primary Examiner*—Sherman D. Basinger
*Assistant Examiner*—Edwin L. Swinehart
*Attorney, Agent, or Firm*—Bachman & LaPointe

[57] ABSTRACT

A reinforced water craft hull structure is disclosed having primary and secondary hull skins predominantly in the region of the hull bottom where the secondary skin functions as an armor or sheathing protecting the primary skin. The primary and secondary skins overlay one another and are connected mechanically so that the skins are movable relative to one another when wear and tear on the secondary skin requires renewal or replacement.

10 Claims, 2 Drawing Sheets

REINFORCED HULL FOR A WATER CRAFT

BACKGROUND OF THE INVENTION

The present invention relates to reinforced hulls for a water craft, such as boats and air craft pontoons, and relates in particular to hulls of the above class having reinforced bottoms for protecting hulls against damage and possible loss of the craft, with which the hulls are associated, due to collision with floating debris, submerged objects or travel over snow, ice, growlers or mixtures thereof.

Most prior art hull structures are designed to meet this problem by providing "double bottoms" having various fixed configurations, such as bouyancy chambers filled with air or flotation and resilient materials sandwiched between bottoms to provide resistance to shock, as well as bouyancy.

Representative prior art structures are disclosed and described in U.S. Pat. Nos. 3,190,587, 3,680,516, 4,667,619 and 4,676,545.

The '619 patent shows a protective cover 7 fixed permanently to a hull 1.

The '545 patent is directed to a chassis structure including fore and aft cradles 10 and 11 connected to a floor tray 12 forming a bed for air, water and land craft of various configurations.

The '587 patent discloses a hull bottom overlay for a water craft which is inflatable to change the contour of the hull to provide stability, extra flotation or improved efficiency.

The '516 patent discloses a double bottom structure where a compressible, shock absorbing cushion is sandwiched between bottoms 2 and 10 and 11.

All of the above structures are fixed in that the extra hull elements are permanently attached.

SUMMARY OF THE INVENTION

In contrast, the present invention provides a water craft hull structure comprising a primary hull skin and a secondary hull skin where the secondary skin is removable and replaceable at will.

Therefore, a primary feature of the invention is the provision of a tough outer skin, armor or sheathing, which protects a water craft hull bottom, which is readily removable for replacement after wear and tear resulting from collision with floating debris, submerged objects, ice, growlers, snow, small land masses and combinations thereof.

A further feature of the invention is the provision of a skin as described above, hereinafter frequently referred to as a secondary skin, which is operative to alter hull configurations consistent with the nature of the surface or medium through which or over which a craft is being operated.

For example, ice, frozen brackish water, growlers, slush and so forth may require a secondary skin having preferred texture or external surface finish as against a surface configuration suitable for conventional water way travel.

A further feature of the invention is the provision of a primary and a secondary skin where the secondary skin is formed with external ribs, fins or other protuberances.

A further feature of the invention is the provision of a double skin hull structure where the hull skins are movable relative to one another.

A further feature of the invention is the provision of means to block said relative motion resulting from frictional forces developed between the secondary skin and the surface supporting the hull when the hull is under way.

A further feature of the invention is the provision of means for keying the primary and secondary hull skins together in releasable fashion.

A further feature of the invention is the provision of a secondary skin which comprises a plurality of elongated elements making an interlocking connection with the primary skin enclosing the bottom of the hull substantially.

A further feature of the invention is the provision of means for blocking motion of the individual elongated elements relative to the primary hull skin when the craft involved is under way.

A still further feature of the invention is the provision of a hull structure having primary and secondary skins which are faired at the forward end of the hull structure.

A further feature of the present invention is the provision of a primary hull skin fabricated from plastic reinforced by fiberglass overlaying a tough shock resistant secondary skin, such as high molecular polyethylene.

A further feature of the invention is the provision of key means in the form of T-shaped tongues mating with cooperating T-shaped slots in the primary or secondary skins for securing the skins together while providing freedom for sliding motion between the skins facilitating renewal or replacement of secondary skins.

It is noted that the hull structure of the present invention i useful on a wide variety of water craft, such as aircraft pontoons, sailboats and motor boats.

In addition, the method of keying the skins together and their relative mobility makes it possible to use a wide variety of materials. In particular, the present invention facilitates use of materials which have been avoided formerly because of their difficulty in bonding adhesively or otherwise. The present invention overcomes the adhesion problem by the structure described above thereby providing the opportunity to select in unlimited fashion materials suitable for the primary skin and materials suitable for the secondary skin independently of their degree of difficulty to bond.

Other features and advantages will become more apparent from an examination of the succeeding specification when read in conjunction with the drawings, in which:

DETAILED DESCRIPTION

Figure 1:
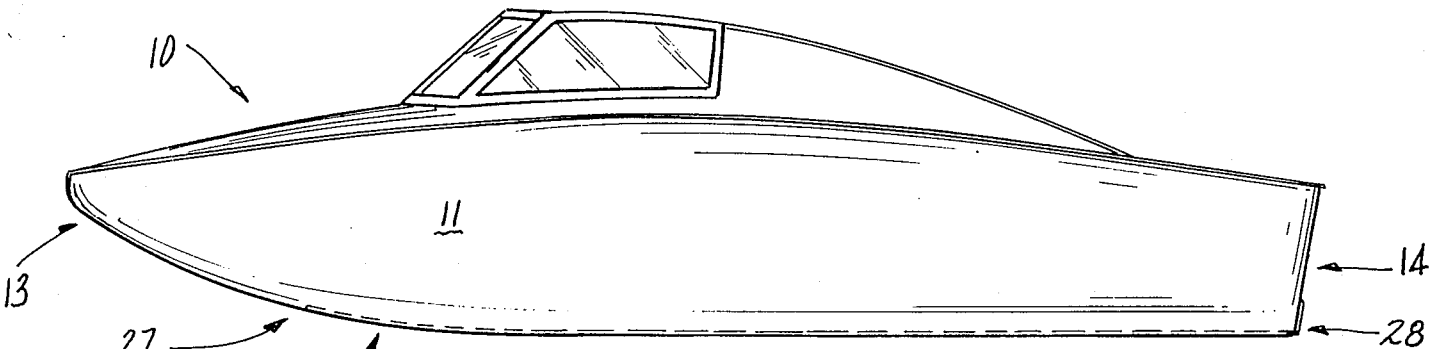
FIG. 1 is a side elevational view of a water craft embracing the principles of the present invention.

Referring now in detail to the drawings, the reference numeral 10 designates a water craft in the form of a motor boat having a hull 11, hull bottom 12, bow 13 and stern 14.

Figures 5, 6, 7:
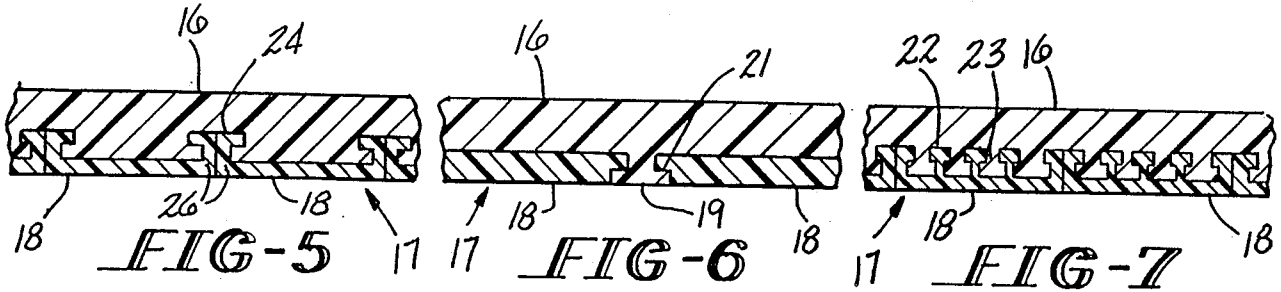

The hull bottom 12 comprises a primary skin 16, as is apparent in FIGS. 5, 6 and 7, keyed to a secondary skin indicated generally by the reference numeral 17.

While the secondary skin 17 defines a plurality of elongated elements 18 spaced apart, as shown in Fiq. 2, or abutting one another, as is apparent in FIGS. 5, 6 and 7, it is anticipated that the secondary skin 17 may comprise a complete unitary overlay substantially covering the hull bottom portion of the, primary skin, i.e. a single, one-piece, seamless unitary secondary skin.

As a practical matter, it is probably more convenient and less difficult to fabricate the secondary skin as a plurality of elongated piece parts as indicated by the reference numeral 18.

The elongated elements 18 (and the one-piece secondary skin) are keyed to the primary hull skin by T-shaped tongues 19 projecting from the primary skin 16 engaging mating grooves or T-slots 21. as shown in FIG. 6. Alternatively, a T-shaped tongue 22 may project from secondary skin elements engaging a mating T-slot 23, as shown in FIG. 7.

FIG. 5 shows an alternative key structure in which a T-slot 24 is formed in primary skin 16 and the T-shaped tongue 26 is formed compositely from mating and abutting elongated secondary skin elements 18.

While the manner of keying the primary and secOndary hull skins in the disclosed embodiment of the invention shows tongues and grooves in the form of T-shaped tongues and slots, it is entirely within the spirit and scope of the invention that any suitable keying system may be used as production and design decisions dictate. The only limitation being that the elements making up the secondary skin, be they the individual elongated spaced or abutted skin elements or a complete unitary single one-piece configuration, be movable relative to the primary skin for replacement.

Figure 2:
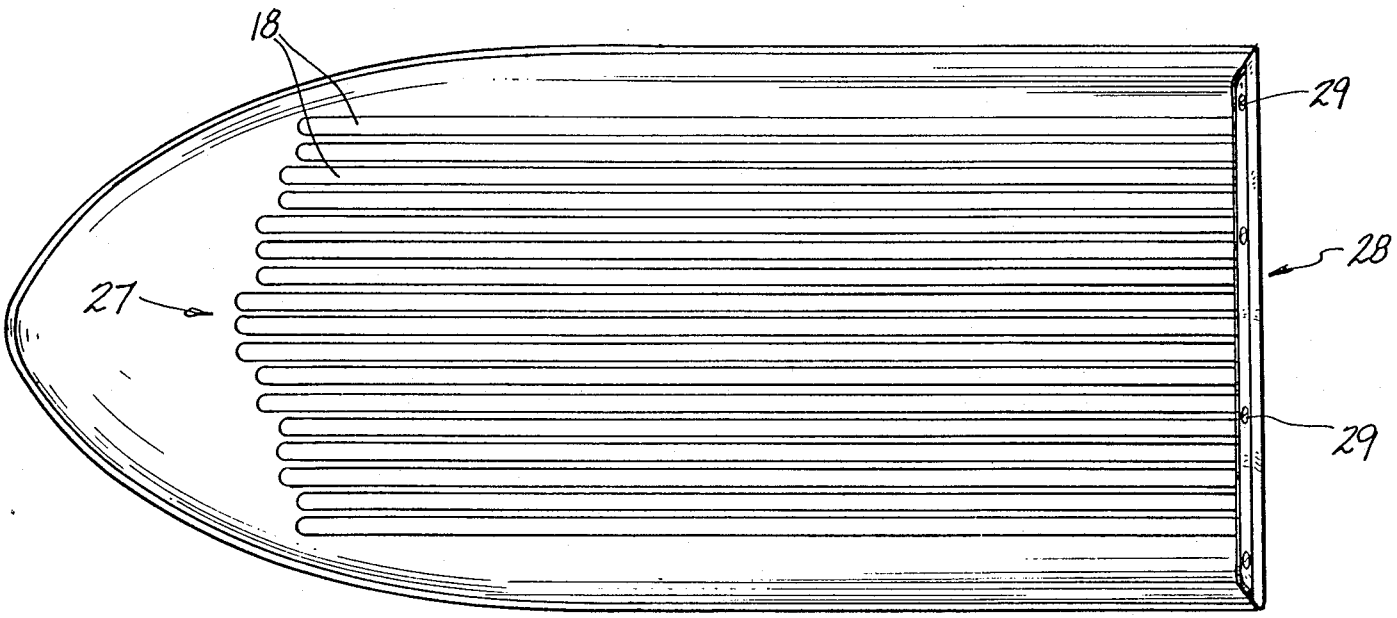
FIG. 2 is a bottom view of the illustration of FIG. 1.
Figure 4:
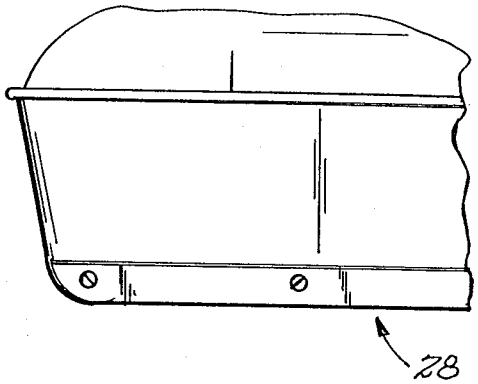
FIG. 4 is a partial view of the illustration of FIG. 3 showing the batten in place, and FIGS. 5, 6 and 7 enlarged cross-sectional views show a variety of means for keying the primary and secondary hull skins together in releasable fashion.

Referring to FIGS. 1 and 2, it is noted that the primary and secondary hull skins are faired and the elongated elements "run out" at the bow or forward portion of the hull bottom as indicated generally by the reference numeral 27.

Friction between the support surface over which a craft is traveling tends to drive the secondary skin to the rear relative to the main body of the craft and the primary hull skin. To avoid this occurrence, a transverse batten indicated generally by the reference numeral 28 spans and overlays the trailing end of the secondary hull skin to block displacement of the secondary skin relative to the primary skin. The batten 28 is secured to the hull transom in any convenient fashion such as by fasteners 29.

Figure 3:
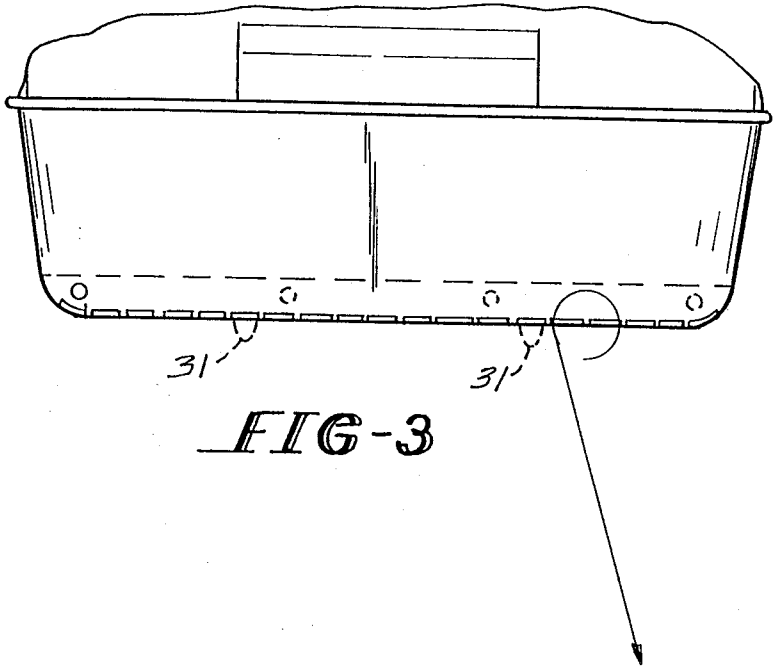
FIG. 3 is an end view of FIG. 1 with the retaining batten removed.

In certain situations depending upon the surface on which the hull is traveling, it has been found desirable to include ribs or fins projecting from the secondary hull skin as identified by the reference numeral 31 in FIG. 3 to provide stability, reduce friction or to prevent excessive wear and tear thereby adding life to the secondary skin.

In other circumstances the exterior surface of the secondary skin is finished with a roughened or textured pattern, in uniform or random fashion to increase the efficiency of the hull structure as it is driven over one or more of the various support surfaces for which the hull structure is adaptable.

It is anticipated that the fins or ribs 31 of FIG. 3 may involve a plurality of fins disposed on opposite sides of the fore and aft center line of the craft.

Therefore, it is not intended that the rib or fin structure be limited to a single pair.

The secondary skin is removed by sliding the skin forward or aft relative to the primary skin, as convenient. Obviously, the batten 28 must be removed to slide the secondary skin or skin elements to the rear.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hull structure for an amphibious craft having inboard and outboard sides, a bow, a stern and a surface engaging bottom;

an inboard primary hull skin, an outboard secondary hull skin coextensive with said bottom, said secondary hull skin comprising a plurality of elongated, side-by-side, elements extending in a fore and aft direction, means for keying said primary and secondary hull skins together releasably whereby said primary and secondary hull skins are relatively movable, said keying means defining an interlocking connection extending in a fore and aft direction between said primary hull skin and said elongated elements, and, retention means secured to the hull structure and in contact with each elongated element collectively operable to block said relative motion resulting from friction forces on said bottom generated when the craft is underway.

2. The hull structure of claim 1 in which the secondary hull skin is co-extensive with the primary skin in the region of the surface engaging bottom and the keying means defines at least one tongue formed in one of said primary and secondary hull skins and at least one mating groove in the other of said primary and secondary hull skins.

3. The hull structure of claim 1 in which the primary and secondary hull skins are faired at the forward end of the hull structure.

4. The hull structure of claim 1 in which the outer surface of at least two elongated elements are each formed with a rib or fin, that is generally co-extensive with said elongated elements.

5. The hull structure of claim 1 in which the primary hull skin is fabricated of plastic reinforced by fiberglass and the secondary hull skin is fabricated from high strength thermoplastic resin.

6. A hull structure for an amphibious craft having inboard and outboard sides, a bow and a stern comprising:

a primary hull skin, a secondary hull skin, and, means for keying said hull skins together in releasable fashion whereby said primary and secondary hull skins are movable relative to one another, means for retaining said secondary hull skin against motion in a predetermined direction, said retention means defining a transverse batten fixed to the stern of the hull overlapping an end portion of said secondary hull skin.

7. The hull structure of claim 6 in which the secondary hull skin is formed with spaced ribs or fins that are generally co-extensive with said secondary skin.

8. A hull structure for an amphibious craft having inboard and outboard sides, a bow and a stern comprising:

a primary hull skin, a secondary hull skin, and, means for keying said hull skins together in releasable fashion whereby said primary and secondary hull skins are movable relative to one another, said secondary hull skin comprising a plurality of elongated elements making an interlocking connection with said primary hull skin, and a transverse batten fixed to the stern of the hull structure overlapping each elongated element to retain each element against motion due to hull friction forces generated when the hull is underway.

9. A hull structure for an amphibious craft having inboard and outboard sides, a bow and a stern comprising:

a primary hull skin, a secondary hull skin, and, means for keying said hull skins together in releasable fashion whereby said primary and secondary hull skins are movable relative to one another, said secondary hull skin comprising a plurality of elongated elements making an interlocking connection with said primary hull skin, said primary hull skin being fabricated of plastic material reinforced by fiberglass and said secondary hull skin being fabricated from high strength or high molecular weight polyethylene.

10. The hull structure of claim 9 including means for retaining the secondary skin elements against motion relative to the primary skin resulting from hull friction forces when the hull is under way.

* * * * *